US007828303B2

(12) United States Patent
Girard et al.

(10) Patent No.: US 7,828,303 B2
(45) Date of Patent: Nov. 9, 2010

(54) GLIDING BOARD ASSEMBLY AND A DEVICE FOR RETAINING AN ARTICLE OF FOOTWEAR ON THE BOARD

(75) Inventors: François Girard, Veyrier du Lac (FR); Eddy Yelovina, Seynod (FR)

(73) Assignee: Salomon S.A.S., Metz-Tessy (FR)

( * ) Notice: Subject to any disclaimer, the term of this patent is extended or adjusted under 35 U.S.C. 154(b) by 490 days.

(21) Appl. No.: 11/802,448

(22) Filed: May 23, 2007

(65) Prior Publication Data

US 2007/0273127 A1 Nov. 29, 2007

(30) Foreign Application Priority Data

May 24, 2006 (FR) ..... 06 04664

(51) Int. Cl.
*A63C 9/00* (2006.01)

(52) U.S. Cl. ..... 280/11.3; 280/607; 280/611; 280/617; 280/618

(58) Field of Classification Search ..... 280/601, 280/607, 609, 611, 617, 618, 620, 11.3, 11.31
See application file for complete search history.

(56) References Cited

U.S. PATENT DOCUMENTS 3,915,466 A * 10/1975 Matsuda ..... 280/617
5,026,086 A * 6/1991 Guers et al. ..... 280/607
5,046,751 A * 9/1991 Scherubl ..... 280/607
5,135,250 A * 8/1992 Abondance et al. ..... 280/617
5,297,812 A * 3/1994 Dogat et al. ..... 280/633
5,480,175 A 1/1996 Astier et al.
5,538,271 A * 7/1996 Abondance ..... 280/602
5,765,854 A * 6/1998 Moore et al. ..... 280/618
6,017,050 A 1/2000 Girard
6,056,310 A * 5/2000 Hangl ..... 280/607
6,315,318 B1 * 11/2001 Caron et al. ..... 280/617
6,935,651 B2 * 8/2005 Krumbeck et al. ..... 280/616
7,290,784 B2 * 11/2007 Heil et al. ..... 280/617
7,296,818 B2 * 11/2007 Krumbeck et al. ..... 280/607
7,431,310 B2 * 10/2008 Redor et al. ..... 280/11.14
7,513,509 B2 * 4/2009 Guyot et al. ..... 280/11.14
2003/0193169 A1 * 10/2003 Holzinger et al. ..... 280/607

(Continued)

FOREIGN PATENT DOCUMENTS

CH 685 102 A5 3/1995

(Continued)

*Primary Examiner*—Glenn Dayoan
*Assistant Examiner*—Vaughn T Coolman
(74) *Attorney, Agent, or Firm*—Greenblum & Bernstein, P.L.C.

(57) ABSTRACT

An assembly for affixing footwear to a gliding board, such as fixing a boot to a cross-country ski, such assembly including a retention device, or binding, an interface to be positioned between the retention device and the gliding board, the interface having a receiving surface for receiving the retention device and the retention device having a support surface to be supported on the interface, the receiving surface of the interface and the support surface of the retention device being mechanically non-compatible. The assembly further includes an adapter to couple the interface to the retention device, the adapter having a support surface mechanically compatible with the receiving surface of the interface, as well as a receiving surface mechanically compatible with the support surface of the retention device, the support and receiving surfaces of the adapter being opposite with respect to one another.

24 Claims, 5 Drawing Sheets

U.S. PATENT DOCUMENTS

| | | | | |
|---|---|---|---|---|
| 2004/0056451 | A1* | 3/2004 | Baikhardt | 280/618 |
| 2005/0116444 | A1 | 6/2005 | Himmetsberger et al. | |
| 2006/0103112 | A1* | 5/2006 | Redor et al. | 280/607 |
| 2007/0138765 | A1* | 6/2007 | Miette et al. | 280/615 |

FOREIGN PATENT DOCUMENTS

| | | | |
|---|---|---|---|
| DE | 19 29 885 | | 12/1970 |
| DE | 10 2004 024 881 | A1 | 7/2005 |
| DE | 20 2005 017 202 | U1 | 4/2006 |
| EP | 1 495 786 | A1 | 1/2005 |
| EP | 1 656 974 | A1 | 5/2006 |
| FR | 2 455 907 | A1 | 12/1980 |
| FR | 2 739 788 | A1 | 4/1997 |
| FR | 2 799 981 | A1 | 4/2001 |
| FR | 2 894 836 | A1 | 6/2007 |

* cited by examiner

GLIDING BOARD ASSEMBLY AND A DEVICE FOR RETAINING AN ARTICLE OF FOOTWEAR ON THE BOARD

CROSS-REFERENCE TO RELATED APPLICATION

This application claims priority under 35 U.S.C. §119 of French Patent Application No. 06.04664, filed on May 24, 2006, the disclosure of which is hereby incorporated by reference thereto in its entirety.

BACKGROUND OF THE INVENTION

1. Field of the Invention

The invention relates to the field of assemblies-that include a gliding board and a device for retaining an article of footwear on the board. Assemblies of this type are adapted to cross-country skiing, alpine skiing, or any other skiing disciplines, or to snowboarding or snow surfing, snowshoeing, or the like.

2. Description of Background and Relevant Information

In the case of alpine skiing, an assembly conventionally includes a gliding board, or ski, an interface provided to be positioned on the board, and a device, or binding, for retaining an article of footwear on the board. The interface has a surface for receiving the retention device, the latter having a support surface on the interface. The receiving surface of the interface and the support surface of the retention device are mechanically compatible. Such assemblies, with interfaces, are adapted to provide particular properties, such as damping, supports, or the like. Assemblies with interfaces have more recently made their way into the field of cross-country skiing, making it easier to mount the retention device.

In the latter case, the receiving surface of the interface and the support surface of the retention device sometimes are not adequate or not at all mechanically compatible. This is the case, for example, when the interface and the retention device are made by different manufacturers and one is not adapted to be function with the other. It can then be difficult or impossible to mount the retention device on the interface. Moreover, when there is no full compatibility, the mounting can generate clearances that can negatively affect the ski steering precision. In other words, affixing the retention device to the gliding board is not optimal.

SUMMARY OF THE INVENTION

In view of the above, the invention makes it possible, or at least easier, to mount a retention device on an interface, which is itself is to be affixed to a gliding board.

More generally, the invention improves the connection of a retention device to a gliding board, particularly to a cross-country ski.

To this end, the invention provides for an assembly that includes a gliding board, an interface provided to be arranged on a portion of the top of the board, and a device for retaining an article of footwear on the board, the interface having a surface for receiving the retention device, the retention device having a support surface on the interface, the receiving and support surfaces being mechanically non-compatible.

The assembly according to the invention includes an adapter for coupling the interface to the retention device, the adapter having a support surface mechanically compatible with the receiving surface of the interface, as well as a receiving surface mechanically compatible with the support source of the retention device, the support and receiving surfaces of the adapter being opposite with respect to one another.

The adapter connects the retention device to the interface, making them mechanically compatible.

Compatibility, for example, can be directed to obtaining a male/female nesting. Compatibility can also mean obtaining support surfaces that are large enough to avoid or reduce deformations of the interface or of the retention device.

An advantage associated with the use of an adapter is being able to mount a given retention device on any of various interfaces or boards.

BRIEF DESCRIPTION OF DRAWINGS

Other characteristics and advantages of the invention can be better understood from the following description, with reference to the annexed drawings showing, by way of non-limiting examples, how the invention can be embodied, and in which.

DETAILED DESCRIPTION OF THE INVENTION

Although the illustrated embodiments relate to a cross-country ski, it is to be understood that the invention also encompasses assemblies that include other boards adapted to the practice of sports such as those mentioned above.

Figure 1:
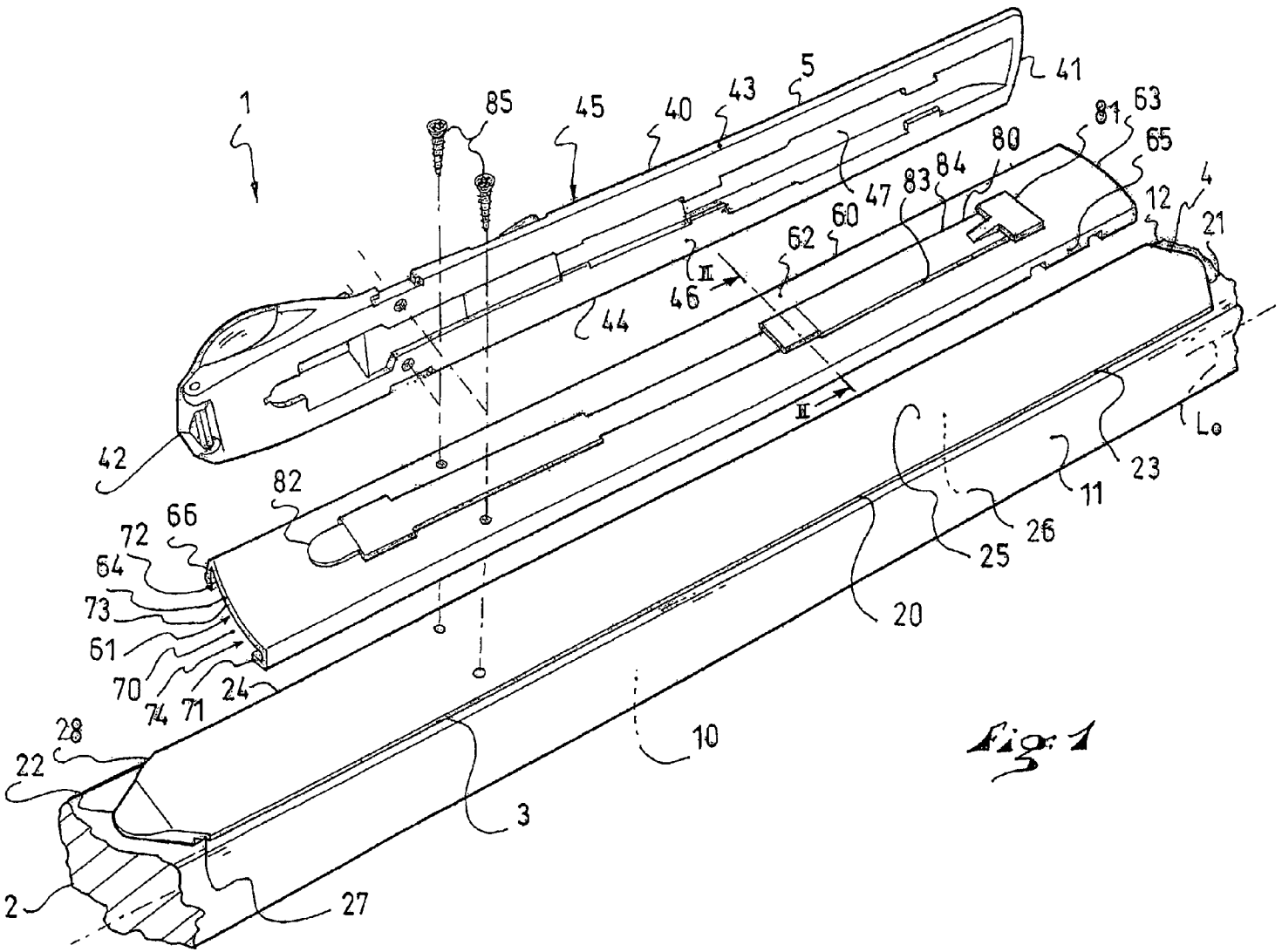
FIG. 1 is a perspective view of an assembly including a gliding board, an interface, an adapter and a retention device, according to a first embodiment of the invention.
Figure 2:
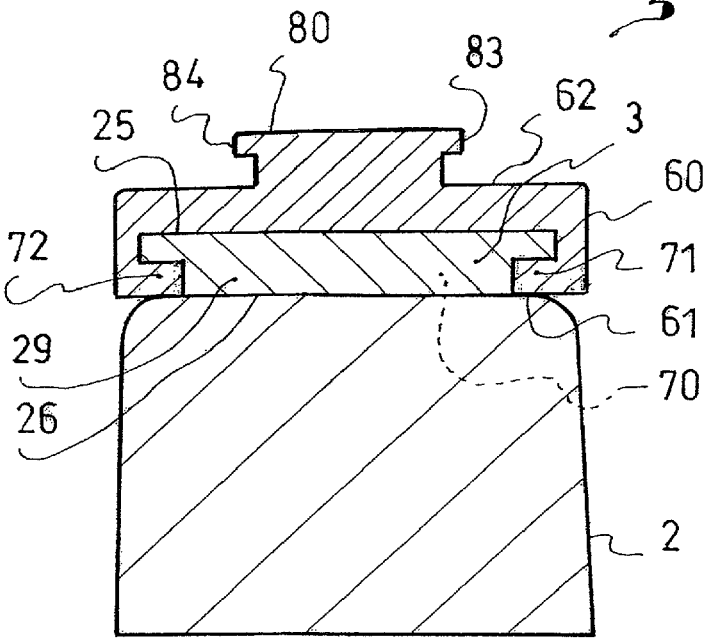
FIG. 2 is a cross-section of the board, interface, and adapter, taken along the line II-II of FIG. 1.

A first embodiment is illustrated in FIGS. 1 and 2.

As is known, an assembly 1, adapted to cross-country skiing, includes a gliding board or ski 2, an interface 3 provided to be arranged on a top portion 4 of the ski, and a device 5 for retaining an article of footwear on the board. Such article of footwear can be a shoe or a boot, including an article of footwear having a low upper, a mid-upper, or a high upper, the latter extending above an ankle of the user.

The ski 2 is only partially shown for reasons of convenience. Opposite the top portion 4, the ski 2 has a gliding surface or bottom portion 10. The ski 2 extends lengthwise along the longitudinal direction Lo, and widthwise between a first edge 11 and a second edge 12.

The interface 3 includes, for example, a plate 20 that extends along the longitudinal direction Lo, between a first end 21 and a second end 22, and transversely between a first edge 23 and a second edge 24. The interface 3 has a support surface 25 provided to receive the retention device 5. A support surface 26 on the interface 3, opposite the receiving surface 25, is affixed to the top portion 4 of the ski 2. The fixing of the interface to the ski is carried out by any appropriate structure or method, such as by means of glue, welding, screws, or the like.

According to the first embodiment illustrated, the interface 3 is glued onto the ski 2. Thereby, the interface is directly affixed to the ski, although the interface could be indirectly affixed.

The transverse cross section of the interface 3 is generally T-shaped, the receiving surface 25 being wider than the support surface 26. In fact, the interface 3 includes a central portion with a first transverse projection 27 on the side of the first edge 23, as well as a second transverse projection 28 on the side of the second edge 24. These projections, which are spaced from and extend across the top portion 4 of the ski, form the T and are adapted to oppose the displacement, away from the receiving surface 25 or from the ski 2, of an element nested on the interface 3. Therefore, the projections 27, 28 provide a vertical retention, i.e., provide vertical retention structure for a boot retention device, i.e., to provide retention structure to retain the boot retention device a against movement in a direction away from an upper surface of the ski.

The retention device 5, or binding, itself is well-known to one of ordinary skill in the art. The retention device 5 includes, for example, a base 40 that extends along the longitudinal direction Lo, between a first end 41 and a second end 42, and transversely between a first edge 43 and a second edge 44. The retention device 5 has a receiving surface 45 provided to receive the article of footwear from a front to a rear thereof, i.e. from the front to the heel. This surface 45 is provided with structure to removably retain the footwear article, as is well-known to one of ordinary skill in the art. Such retaining device can be that which is disclosed, for example, in the document FR 2 739 788 and in U.S. Pat No. 6,017,050, the disclosure of the latter document herewith being incorporated by reference thereto in its entirety. Such retaining device includes a longitudinally extending guide rib for cooperating with a longitudinal groove in the sole of the footwear article to guide same.

The retention device 5 also has a support surface 46 provided to be supported on the ski, either directly or indirectly, via an interface. To this end, the support surface 46 includes structure for removably retaining the device 5 on an interface. Such structure can be that which is disclosed, for example, in FR 2894836, published on Jun. 22, 2007, and in US. 2007/0138765, published on Jun. 21, 2007, the disclosure of the latter document herewith being incorporated by reference thereto in its entirety. The removable retention structure includes a longitudinal groove 47 with a varying width, made in the support surface 46. It is provided to nest the retention device 5 on an interface, and then to immobilize it by any of various structures, such as screws, ratchet locking, or the like.

In the illustrated assembly, however, the receiving surface 25 of the interface 3 and the support surface 46 of the retention device 5 are mechanically non-compatible. This means that if one were to attempt to connect the surfaces 25, 46 directly one to the other, no nesting or ratchet locking would be possible. Moreover, the distribution of support forces is unreliable, and the distribution of the mechanical stresses uneven, thereby not permitting one to use the ski or gliding board safely, inasmuch as the retention device/binding 5 could become detached relative to the ski/board inadvertently. Thus, the interface 3 and the retention device 5 do not cooperate mechanically without adding another element.

This is due particularly to the fact that the interface 3 is wider than the groove 47 of the retention device 5. It is not possible to insert the rib 29 of the interface 3 in the groove 47 of the retention device 5. Therefore, it is not possible to obtain a direct connection of the retention device 5 to the interface 3 by means of the vertical retention structure comprised of the projections 27, 28 of the aforementioned T-shape.

Further, for this reason, the invention provides an adapter 60 for connecting the interface 3 and the retention device 5, the adapter having a support surface 61 that is mechanically compatible with the receiving surface 25 of the interface 3, as well as a receiving surface 62 that is mechanically compatible with the support surface 46 of the retention device 5, the support 61 and receiving 62 surfaces of the adapter 60 being opposite with respect to one another.

The adapter 60 is a supplemental element that is included in the assembly 1 in order to make the interface 3 and retention device 5 mechanically compatible. The interface 3 and retention device 5 are indirectly connected to one another, but the connection is mechanically stable.

The adapter 60 makes it possible to connect an interface and a retention device to one another, which originally were not adapted to cooperate. A resulting advantage, for example, is simplifying manufactured lines of products. Therefore, one can provide to mount the same retention device on various interfaces or various skis. Indeed, the adapter is inexpensive in view of the retention device. The cost savings are thus substantial.

According to the first embodiment illustrated, the adapter 60 extends longitudinally along the longitudinal direction Lo, between a first end 63 and a second end 64. The adapter extends transversely between a first edge 65 and a second edge 66, and height-wise between the support surface 61 and the receiving surface 62.

The support surface 61 has a longitudinal groove 70 that is transversely demarcated by a first inner edge 71 opposite a second inner edge 72. Thus, the bottom 73 of the groove 70 is wider than the opening 74. The groove 70 of the adapter 60 is dimensioned to receive the rib 29 of the interface 3. Further, the projections 27, 28 are received in the lateral grooves above the edges 71, 72, respectively, the projections 27, 28 overlapping the edges 71, 72. The adapter 60 is associated with the interface 3 by sliding along the longitudinal direction Lo.

In the same context, the receiving surface 62 has a rib 80 that extends along the longitudinal direction Lo, between a first end 81 and a second end 82, and transversely between a first edge 83 and a second edge 84. The rib 80 has, for example, a T-shaped transverse cross-section on at least a portion of its length. The rib 80 has a configuration that enables the groove 47 of the retention device 5 to receive it, so that the rib 80 can be retained in the groove. The connection can be done, for example, by nesting followed by sliding over a limited range. This technique is well-known to one of ordinary skill in the art, and can be that which is disclosed in the above-referenced documents.

The rib 80 on the receiving surface 62 of the adapter 60 is narrow with respect to the groove 70 on the support surface 61.

According to the first embodiment illustrated, the retention device 5 and the adapter 60 are immobilized longitudinally in relation to the interface 3 and to the ski 2 by a common immobilization mechanism, which, for example, includes screws 85. Two screws are provided in this case, which extend through the retention device 5, the adapter 60, and the interface 3 in order to be screwed into the ski 2. Thus, the screws 85 prevent longitudinal and transverse movements of the retention device 5, adapter 60, and interface 3 in relation to the ski 2. The screws 85 tighten all of the main elements 5, 60, 3 at the same time on the ski 2. A resulting advantage is the elimination of clearances or any play. As a result, steering the ski is more precise, and the use of the assembly more pleasant.

A different number of screws, for example, one screw, three screws, or more, can be provided. At least one screw 85 is provided.

Other arrangements or mechanisms for immobilization, such as ratchet devices, could be used instead of screws.

The other embodiments of the invention are shown hereinafter in FIGS. 3 to 6. For simplification, only their specific characteristics in relation to the first embodiment will be shown.

Figure 3:
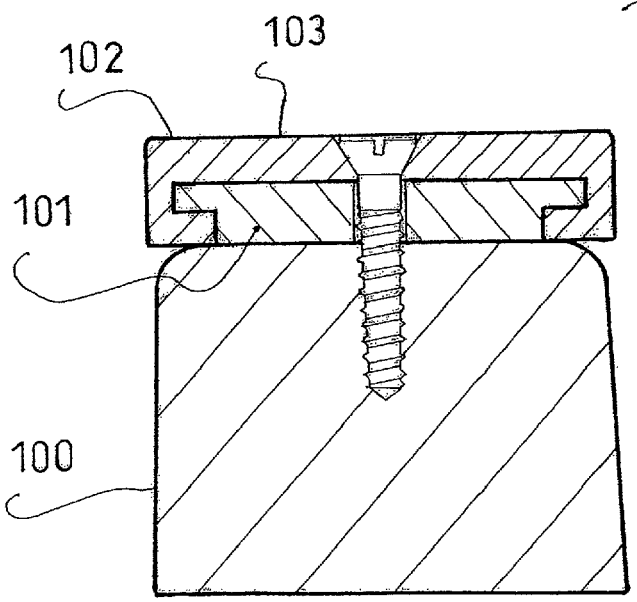
FIG. 3 is a cross-section similar to FIG. 2, for a second embodiment of the invention.

The second embodiment is shown in FIG. 3, featuring a ski 100, an interface 101, and an adapter 102 in transverse cross-section. The second embodiment differs from the first embodiment in that the receiving surface 103 of the adapter 102 is substantially planar, or flat, even if the receiving surface 103 has a hollow structure adapted to lighten the structure without modifying its function.

This adapter 102 makes it possible to mount on the interface 3 retention devices that have a substantially planar or flat support surface.

Figure 4:
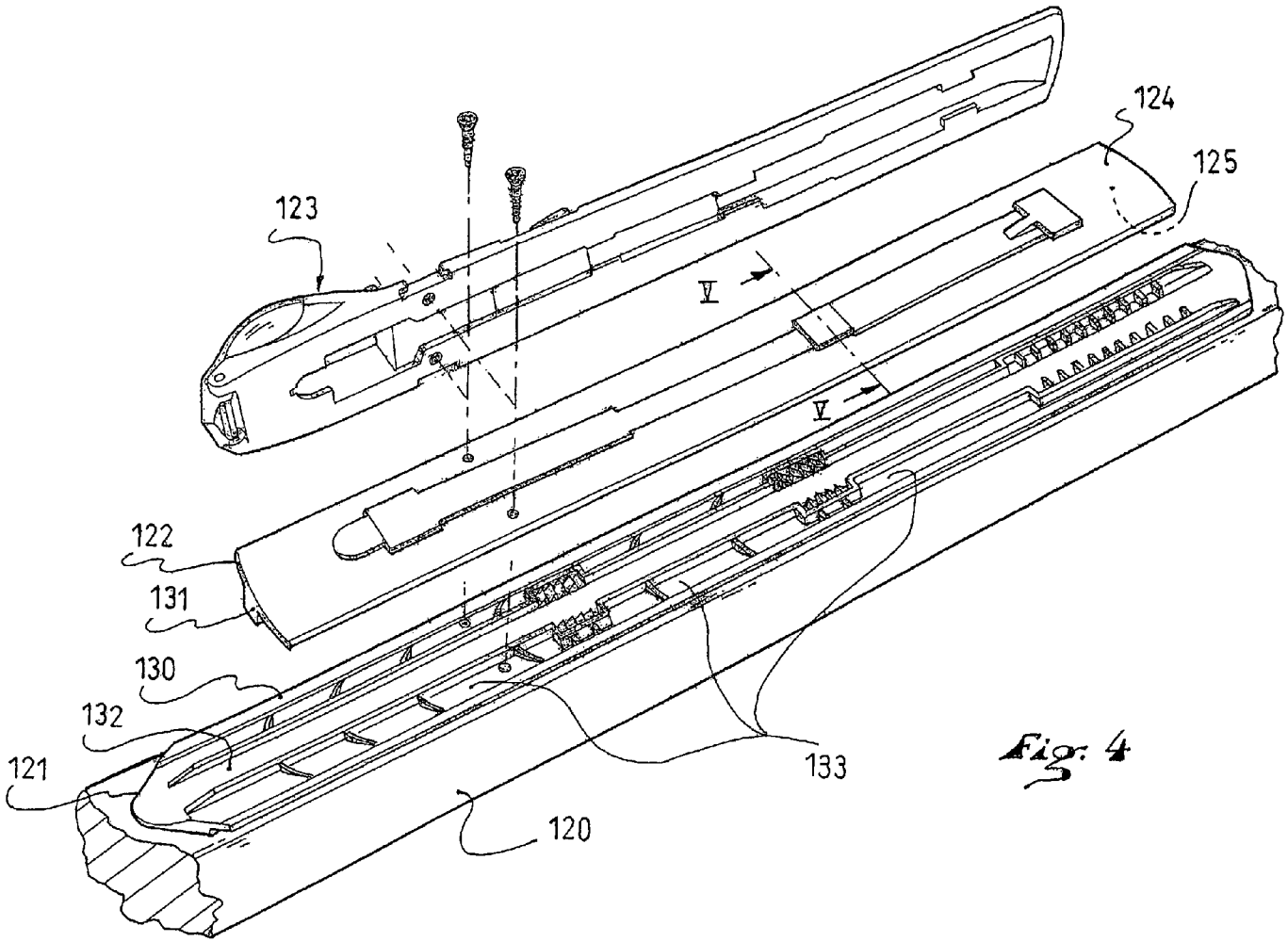
FIG. 4 is a perspective view of an assembly including a board, an interface, an adapter, and a retention device, according to a third embodiment of the invention.
Figure 5:
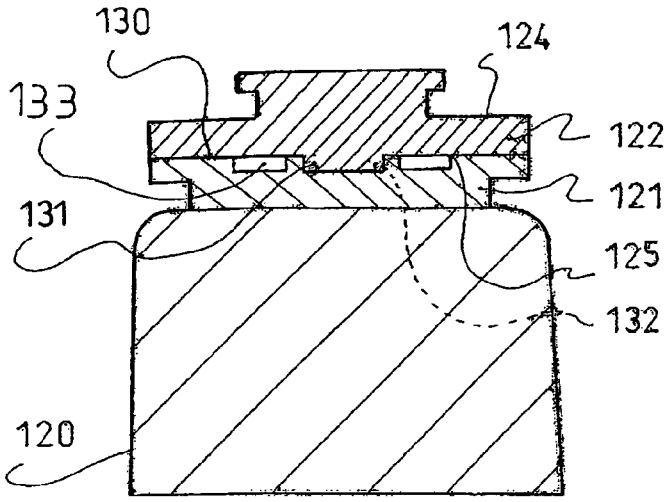
FIG. 5 is a cross-section of the board, interface, and adapter, taken along the line V-V of FIG. 4.

The third embodiment is shown in FIGS. 4 and 5, featuring a ski 120, an interface 121, an adapter 122, and a retention device 123. The latter is, for example, identical to that of the first embodiment. Similarly, the receiving surface 124 of the adapter 122 is identical to that of the first embodiment. The difference lies in the support surface 125 of the adapter 122, which is substantially planar. Moreover, a male/female nesting arrangement is provided between the support surface 125 of the adapter 122 and the receiving surface 130 of the interface 121. To obtain this nesting arrangement, a relief, such as a rib 131, is arranged on the support surface 125 of the adapter. Similarly, a complementary relief, such as a groove 132, is provided in the receiving surface 130 of the interface 121. The rib 131 is provided to nest into the groove 132. The rib and groove are each oriented longitudinally, which provides stability to the assembly of the adapter 122 with the interface 121. However, the nesting arrangement is not mandatory. Although the receiving surface 130 of the interface 121 is generally planar, it also has cavities 133, providing the interface 121 with a hollow structure.

Figure 6:
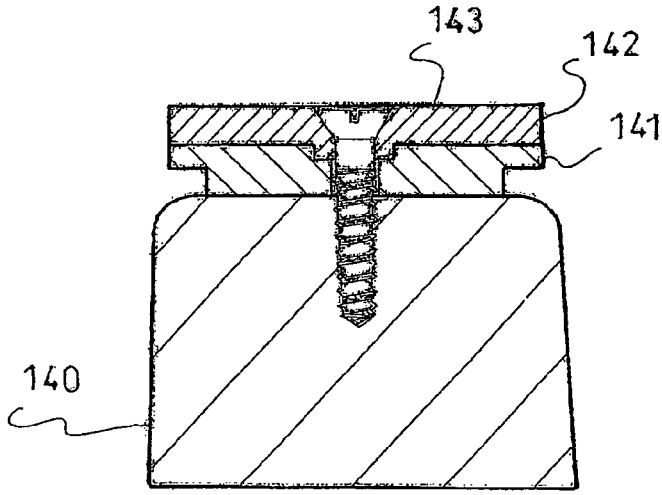
FIG. 6 is a view similar to FIG. 5, for a fourth embodiment of the invention.

The fourth embodiment is shown in FIG. 6, featuring a ski 140, an interface 141, and an adapter 142 in a transverse cross-section. The fourth embodiment differs from the third embodiment in that the receiving surface 143 of the adapter 142 is substantially planar; although the receiving surface 143 can have open cavities adapted to lighten the structure without modifying its function.

Figure 7:
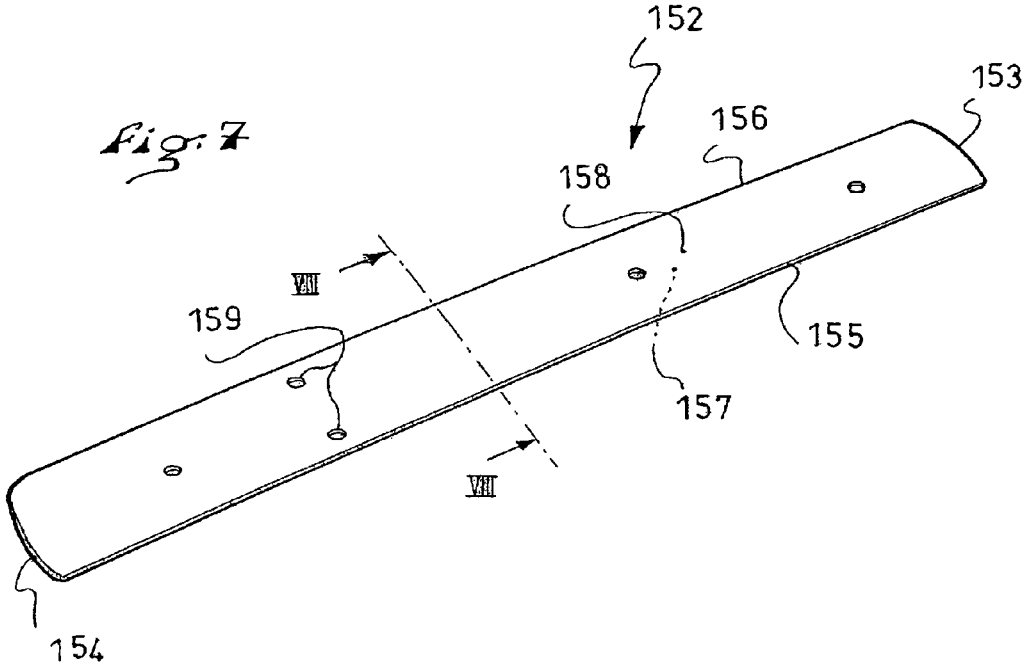
FIG. 7 is a perspective view of an adapter for a fifth embodiment of the invention.
Figure 8:
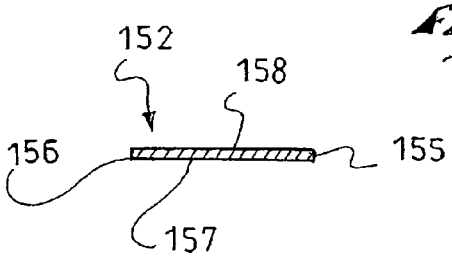
FIG. 8 is a cross-section taken along the line VIII-VIII of FIG. 7.

The fifth embodiment is shown in FIGS. 7 and 8, featuring an adapter 152, which extends lengthwise from a first end 153 up to a second end 154, and width-wise between a first edge 155 and a second edge 156. The adapter also extends heightwise between a support surface 157 and a receiving surface 158.

According to the fifth embodiment of the invention, the support surface 157 is planar, which enables it to be supported, for example, on the receiving surface 130 of the interface 121 that is shown in FIG. 4. In fact, a planar support surface 157 is supported on the various ribs of the interface 121.

The receiving surface 158 of the adapter 152 is also planar, which enables it to receive various types of retention devices, including the one designated by the reference numeral 123 and shown in FIG. 4.

With further respect to FIGS. 7 and 8, the support 157 and receiving 158 surfaces are parallel to one another, which makes it possible to arrange a retention device so that it is parallel to a ski.

These surfaces 157 and 158 can also be provided to be non-parallel with respect to one another. In such a case, the first end 153 can be thicker or thinner than the second end 154. Also, the first edge 155 can be thicker or thinner than the second edge 156. The retention device can therefore be inclined longitudinally or transversely in relation to the ski.

Finally, according to the fifth embodiment of the invention, the adapter 152 can be a flat blade that is wedged between an interface and a retention device, still within the context of associating one with the other.

The adapter can include plastic materials or resins, whether reinforced or non-reinforced with synthetic or natural fibers. Glass or carbon, for example, can be used.

The adapter 152 is also provided to have holes 159 to allow the retaining screws of a retention device to pass through. For example, three longitudinally aligned holes, as well as two transversely oriented holes are provided, which forms a set of five holes. This example is, however, not limiting.

For all of the embodiments, the invention is made from materials and according to implementation techniques that are known to one of ordinary skill in the art.

The invention is not limited to the particular embodiments described hereinabove; it includes all of the equivalent embodiments that may fall within the scope of the claims that follow.

In particular, other structures can be provided for the support and receiving surfaces of an adapter.

The invention claimed is:

1. An assembly for affixing footwear to a gliding board, said assembly comprising:

a retention device for retaining an article of footwear on the gliding board, the retention device including a receiving surface having a length extending from a front to a heel of the article of footwear;

an interface adapted to be arranged on a top portion of the gliding board;

the interface having a receiving surface for receiving the retention device, and the retention device having a support surface to be supported on the interface;

the interface having vertical retention structure adapted to be engaged with a compatible retention device to retain such compatible retention device from movement away from the gliding board;

the receiving surface of the interface and the support surface of the retention device being mechanically non-compatible, thereby not allowing nesting of the retention device with the interface without an adapter;

an adapter to couple the interface to the retention device, the adapter comprising:

a support surface mechanically compatible with the receiving surface of the interface;

a receiving surface mechanically compatible with the support surface of the retention device;

the support surface of the adapter and the receiving surface of the adapter being opposite with respect to one another.

2. An assembly according to claim 1, wherein:

the support surface of the adapter is substantially planar.

3. An assembly according to claim 2, wherein:

a nesting arrangement is provided between the support surface of the adapter and the receiving surface of the interface.

4. An assembly according to claim 3, wherein:

the nesting arrangement includes a rib arranged on the support surface of the adapter and a groove in the receiving surface of the interface.

5. An assembly according to claim 1, wherein:

the receiving surface of the adapter is substantially planar.

6. An assembly according to claim 5, wherein:

the receiving surface of the adapter has open cavities.

7. An assembly according to claim 1, wherein:

the support surface of the adapter has a longitudinal groove transversely demarcated by a first inner edge opposite a second inner edge.

8. An assembly according to claim 1, wherein:

the retention device is a binding having a mechanism for connecting a front portion of the article of footwear while allowing a heel of the article of footwear to be moved away from the gliding board during use.

9. An assembly according to claim 1, wherein:

at least one screw has a length to extend through the retention device, the adapter, and the interface and to be screwed into the gliding board.

10. An assembly according to claim 1, wherein:

the receiving surface of the interface has cavities.

11. A gliding board assembly comprising:

a gliding board, the retention device including a receiving surface having a length extending from a front to a heel of the article of footwear;

a retention device for retaining an article of footwear on the gliding board;

an interface having a support surface adapted to be affixed to a top portion of the gliding board;

the interface having a receiving surface for receiving the retention device, and the retention device having a support surface to be supported on the interface;

the interface having vertical retention structure adapted to be engaged with a compatible retention device to retain such compatible retention device from movement away from the gliding board;

the vertical retention structure includes portions spaced above and extending across a top portion of the gliding board when the interface is affixed to the gliding board;

the receiving surface of the interface and the support surface of the retention device being mechanically non-compatible, thereby not allowing use of the retention device with the interface without an adapter;

an adapter to couple the interface to the retention device, the adapter comprising:

a support surface mechanically compatible with the receiving surface of the interface; and a receiving surface mechanically compatible with the support surface of the retention device;

the support surface of the adapter and the receiving surface of the adapter being opposite with respect to one another.

12. An assembly according to claim 11, wherein:

the interface has a T-shaped transverse cross section comprised of a rib and a pair of lateral projections;

the portions of the vertical retention structure are said lateral projections, said lateral projections being spaced above and extending across a top portion of the gliding board when the interface is affixed to the gliding board.

13. A gliding board assembly comprising:

a gliding board;

a retention device for retaining an article of footwear on the gliding board, the retention device including a receiving surface having a length extending from a front to a heel of the article of footwear;

an interface having a support surface adapted to be affixed to a top portion of the gliding board;

the interface having a receiving surface for receiving the retention device, and the retention device having a support surface to be supported on the interface;

the interface having vertical retention structure adapted to be engaged with a compatible retention device to retain such compatible retention device from movement away from the gliding board;

the receiving surface of the interface and the support surface of the retention device being mechanically non-compatible, thereby not allowing nesting of the retention device with the interface without an adapter;

an adapter to couple the interface to the retention device, the adapter comprising:

a support surface mechanically compatible with the receiving surface of the interface; and a receiving surface mechanically compatible with the support surface of the retention device;

the support surface of the adapter and the receiving surface of the adapter being opposite with respect to one another.

14. An assembly according to claim 13, wherein:

said gliding board is a cross-country ski; and said ski is adapted to support, width-wise of the ski, only a single article of footwear of a skier using said ski.

15. An assembly according to claim 13, wherein:

said gliding board is a cross-country ski; and said retention device is a cross-country binding, said binding having a mechanism for connecting a front portion of the article of footwear while allowing a heel of the article of footwear to be moved away from the gliding board.

16. An assembly for affixing footwear to a gliding board, said assembly comprising:

a retention device for retaining an article of footwear on the gliding board, the retention device including a receiving surface having a length extending from a front to a heel of the article of footwear;

an interface adapted to be arranged on a top portion of the gliding board;

the interface having a receiving surface for receiving the retention device, and the retention device having a support surface to be supported on the interface;

the interface having vertical retention structure adapted to be engaged with a compatible retention device to retain such compatible retention device from movement away from the gliding board, the vertical retention structure including portions spaced above and extending across a top portion of the gliding board when the interface is affixed to the gliding board;

the receiving surface of the interface and the support surface of the retention device being mechanically non-compatible, thereby not allowing use of the retention device with the interface without an adapter;

an adapter to couple the interface to the retention device, the adapter comprising:

a support surface mechanically compatible with the receiving surface of the interface;

a receiving surface mechanically compatible with the support surface of the retention device;

the support surface of the adapter and the receiving surface of the adapter being opposite with respect to one another.

17. An assembly according to claim 16, wherein:

the interface has a T-shaped transverse cross section comprised of a rib and a pair of lateral projections;

the portions of the vertical retention structure are said lateral projections, said lateral projections being spaced above and extending across a top portion of the gliding board when the interface is affixed to the gliding board.

18. An assembly for affixing footwear to a gliding board, said assembly comprising:

a retention device for retaining an article of footwear on the gliding board;

an interface adapted to be arranged on a top portion of the gliding board;

the interface having a receiving surface for receiving the retention device, and the retention device having a support surface to be supported on the interface;

the interface having vertical retention structure adapted to be engaged with a compatible retention device to retain such compatible retention device from movement away from the gliding board:

the receiving surface of the interface and the support surface of the retention device being mechanically non-compatible, thereby not allowing use of the retention device with the interface without an adapter;

an adapter to couple the interface to the retention device, the adapter comprising:

a support surface mechanically compatible with the receiving surface of the interface;

a receiving surface mechanically compatible with the support surface of the retention device, the receiving surface having a rib;

the support surface of the adapter and the receiving surface of the adapter being opposite with respect to one another.

19. An assembly according to claim 18, wherein:

the rib on the receiving surface of the adapter is narrower than the groove on the support surface of the adapter.

20. An assembly according to claim 18, wherein:

the rib has a T-shaped transverse cross-section.

21. An assembly for affixing footwear to a gliding board, said assembly comprising:

a retention device for retaining an article of footwear on the gliding board;

an interface adapted to be arranged on a top portion of the gliding board;

the interface having a receiving surface for receiving the retention device, and the retention device having a support surface to be supported on the interface;

the receiving surface of the interface and the support surface of the retention device being mechanically non-compatible, thereby not allowing use of the retention device with the interface without an adapter;

an adapter to couple the interface to the retention device, the adapter comprising:

a support surface mechanically compatible with the receiving surface of the interface;

a receiving surface mechanically compatible with the support surface of the retention device, the receiving surface of the adapter having rib, the rib having a T-shaped transverse cross-section;

the support surface of the adapter and the receiving surface of the adapter being opposite with respect to one another.

22. A gliding board assembly comprising:

a gliding board;

a retention device for retaining an article of footwear on the gliding board;

an interface having a support surface adapted to be affixed to a top portion of the gliding board;

the interface having a receiving surface for receiving the retention device, and the retention device having a support surface to be supported on the interface;

the interface having vertical retention structure adapted to be engaged with a compatible retention device to retain such compatible retention device from movement away from the gliding board;

the receiving surface of the interface and the support surface of the retention device being mechanically non-compatible, thereby not allowing use of the retention device with the interface without an adapter;

an adapter to couple the interface to the retention device, the adapter comprising:

a support surface mechanically compatible with the receiving surface of the interface; and a receiving surface mechanically compatible with the support surface of the retention device;

the support surface of the adapter and the receiving surface of the adapter being opposite with respect to one another;

at least one screw having a length to extend through the retention device, the adapter, and the interface and to be screwed into the gliding board, to tighten the retention device, the adapter, and the interface to the ski.

23. An assembly for affixing footwear to a gliding board, said assembly comprising:

a retention device for retaining an article of footwear on the gliding board, the retention device including a receiving surface having a length extending from a front to a rear of the article of footwear;

an interface adapted to be arranged on a top portion of the gliding board;

the interface having a receiving surface for receiving the retention device, and the retention device having a support surface to be supported on the interface;

the interface having vertical retention structure adapted to be engaged with a compatible retention device to retain such compatible retention device from movement away from the gliding board;

the receiving surface of the interface and the support surface of the retention device being mechanically non-compatible, thereby not allowing use of the retention device with the interface without an adapter;

an adapter to couple the interface to the retention device, the adapter comprising:

a support surface mechanically compatible with the receiving surface of the interface;

a receiving surface mechanically compatible with the support surface of the retention device;

the support surface of the adapter and the receiving surface of the adapter being opposite with respect to one another.

24. A gliding board assembly comprising:

a gliding board;

a retention device for retaining an article of footwear on the gliding board, the retention device including a receiving surface having a length extending from a front to a rear of the article of footwear;

an interface having a support surface adapted to be affixed to a top portion of the gliding board;

the interface having a receiving surface for receiving the retention device, and the retention device having a support surface to be supported on the interface;

the interface having vertical retention structure adapted to be engaged with a compatible retention device to retain such compatible retention device from movement away from the gliding board;

the receiving surface of the interface and the support surface of the retention device being mechanically non-compatible, thereby not allowing use of the retention device with the interface without an adapter;

an adapter to couple the interface to the retention device, the adapter comprising:

a support surface mechanically compatible with the receiving surface of the interface; and a receiving surface mechanically compatible with the support surface of the retention device;

the support surface of the adapter and the receiving surface of the adapter being opposite with respect to one another.

* * * * *